US005472137A

United States Patent [19]

Jenkins

[11] Patent Number: 5,472,137

[45] Date of Patent: Dec. 5, 1995

[54] SIFT PROOF CARTON AND METHOD OF MAKING

[75] Inventor: Paul M. Jenkins, Yorba Linda, Calif.

[73] Assignee: Illinois Tool Works Inc., Glenview, Ill.

[21] Appl. No.: 273,120

[22] Filed: Jul. 11, 1994

[51] Int. Cl.[6] ..... B65D 5/06

[52] U.S. Cl. ..... 229/134; 229/136

[58] Field of Search ..... 229/132, 134, 229/162, 136

[56] References Cited

U.S. PATENT DOCUMENTS

| | | | |
|---|---|---|---|
| 2,996,235 | 8/1961 | Turpin | 229/132 X |
| 3,040,958 | 6/1962 | Hagan | 229/132 |
| 3,140,215 | 7/1964 | Russell | 229/132 X |
| 3,194,473 | 7/1965 | Rumberger | 229/132 |
| 3,286,906 | 11/1966 | Rumberger | 229/132 X |
| 3,934,791 | 1/1976 | Dick et al. | 229/134 X |
| 4,088,263 | 5/1978 | Michetti | 229/132 |
| 4,501,388 | 2/1985 | Cassidy | 229/134 X |
| 4,530,461 | 7/1985 | Adamek | 229/134 |
| 4,989,780 | 2/1991 | Foote et al. | 229/132 X |

*Primary Examiner*—Allan N. Shoap
*Assistant Examiner*—Christopher J. McDonald
*Attorney, Agent, or Firm*—Schwartz & Weinrieb

[57] ABSTRACT

A sift proof carton and method of folding and sealing the major and minor end flaps of a carton to provide a sift proof container wherein the method includes providing a carton having first and second inside and outside major flaps and a pair of minor flaps, and folding the minor flaps to substantially cover an open end of the carton. Opposite sides of the first inside major flap are then mitered and both the first and second major flaps are positioned in open positions with respect to the carton. The carton is then put in motion and, during such motion, an adhesive pattern is applied from a stationary adhesive nozzle member to selected areas of the second outside major flap and the minor flaps. The first inside major flap is then folded onto the minor flaps followed by the second outside major flap which provides direct sealing contact between the second outside major flap and both minor flaps as well as portions of the first inside major flap so as to provide the sift proof carton.

11 Claims, 3 Drawing Sheets

SIFT PROOF CARTON AND METHOD OF MAKING

TECHNICAL FIELD

The present invention relates generally to methods for erecting and adhesively sealing cartons, and more particularly to a linerless sift proof carton and method of sealing the carton that utilizes a two surface folding method and predetermined adhesive pattern to provide increased sealing of either end of a carton and is particularly effective for increasing the sealing of the corners of the carton and thereby preventing leakage of granular contents from the sealed carton regardless of grain size.

BACKGROUND OF THE INVENTION

A carton, box or container is typically made of a paper material, such as paperboard or the like, and includes a plurality of flaps at opposite open ends of the carton which must be folded and connected to provide a closed carton. Such cartons are usually provided in a flat, folded state to a manufacturer who then erects the carton, closes and seals one open end, inserts a desired product, and closes and seals the opposite end of the carton.

Machinery for erecting, folding and sealing a carton with a product therein are either intermittent or continuous motion systems. In an intermittent system, the carton is sequentially conveyed to a plurality of positions along an assembly line where the carton is stopped for a predetermined time period at each position so that a desired operation can be performed on the carton. In such a system, since the carton is substantially stationary for a short period of time, machinery can be provided at each position which is movable with respect to the stationary carton to provide the desired operation.

In a continuous motion system, cartons are continuously in motion, one after another, through the system. As the cartons move through the system, they cooperate with various apparatus which are substantially stationary with respect to the moving cartons and provide the desired operations on the cartons. Continuous motion systems dramatically increase the output approximately 5–10 times that of an intermittent system, and generally require completely different equipment.

Cartons are typically closed by folding end flaps of the carton using what is known as a "three surface conventional fold" method or pattern and then securing the flaps together with tape, an adhesive or with some other means. In a three surface conventional fold method, opposite minor end flaps are first folded, followed by a first inside major flap and finally a second outside major flap. Thus, as FIG. 3 illustrates, the carton ends are closed by three layers of flaps or surfaces, each of which extends across the open end and between which an adhesive layer is positioned.

When a carton contains a granular or powdered product, the powder can tend to work its way out of the carton between the folded and secured flaps during shipping and handling. One way to prevent such leakage is to provide the carton with an inner liner or pouch, such as a plastic bag. A liner, however, significantly increases the cost of the carton, can make the carton difficult to fill and seal with product, and can be difficult to recycle since most users neglect to remove and separate the carton and liner for respective recycling.

Attempts to prevent leakage without a liner include providing a "sift proof" carton which is preferably sealed with an adhesive. Sift proof adhesively sealed cartons rely on a precise predetermined pattern of a substantially quick setting adhesive and proper engagement between respective flaps.

Adhesively sealed sift proof cartons folded in accordance with a three surface conventional fold method have not been acceptable, particularly for relatively small grained powders, since such powders leak at the corners as well as at improperly sealed edges. Corner leakage primarily occurs from poor adhesion between the minor flaps and the first inside major flap, particularly at the proximal end of the first inside major flap which requires two corner seals of the carton. Edge leakage occurs due to the inability of existing methods and equipment to provide adhesive in exact locations with uniform consistency as explained in detail hereinafter.

Another way of closing a carton is in accordance with a two surface folding method which typically includes modifying the shape of the first inside major flap to enable direct contact between the minor flaps and the second outside major flap. Such methods tend to be more effective at preventing leakage of granular material since a sealing layer between the inside and outside major flaps is substantially eliminated as compared to the three surface conventional fold.

Existing two surface folding methods, however, which have been typically utilized in poly coated/flame bonded methods as well as intermittent systems, still exhibit poor corner sealing and edge sealing. In a poly coated/flame bonded method, the entire surface of each flap is coated with a polymer, such as plastic or the like, and then passed over a flame which melts the plastic and adheres the flaps together. In such methods, the plastic coating on all surfaces not only can be costly, but also is undesirable aesthetically and can have an adverse reaction with certain carton contents. The plastic coating can also create a limited line speed for some applications. Thus, the use of this method is limited.

As FIG. 15 illustrates, existing intermittent two surface folding methods utilize two distinct adhesive heads which move in predetermined patterns with respect to the stationary carton to provide two distinct adhesive patterns. One head applies a straight bead of adhesive on the inwardly folded minor flaps. The other head applies a substantially U-shaped bead of adhesive on portions of the minor flaps and extending about the periphery of the second outside major flap at a distance from the edge thereof. The U-shaped bead is provided by turning on the adhesive head at one end of the pattern and then depositing adhesive on the desired surfaces with at least two ninety degree turns. Thus, due to the motion required of the adhesive heads, such a method cannot be utilized on a continuous motion system.

As illustrated, the adhesive tends to glob when the head is turned on and off as well as at the corners and also tends to thin out proximate the center of each bead of adhesive. Such thinning occurs primarily due to the acceleration and deceleration of the adhesive head from the starting, stopping and turning motions.

Adhesive beads that are not uniform cause leakage because of the "open time" or curing of the adhesive selected for the particular application. In such an intermittent process, due to the time required to deposit the adhesive and advance the carton to the next station for folding engagement of the flaps, an adhesive with a substantially longer open time is preferably selected. Additionally, the adhesive must bridge the gap between the minor flaps and the outside major flap.

The open time is chosen so that upon contact of the adhesive with a particular folded flap, the adhesive is in a state where it grips the flap upon compression and sets so that upon release of compression the flap is secured. Accordingly, the dimensions of the bead as well as the selection of adhesive and timing of the system are important in obtaining a sift proof seal.

In view of the above, if the bead of applied adhesive is too thin, such as occurs toward the middle of the bead, the open time is decreased. Thus, the adhesive solidifies before making contact with the desired flap.

If the bead is too thick, such as where the globs occur, the larger mass of adhesive retains heat thereby lengthening the open time which fails to grip or hold a seal with the respective flap. In either event, a good seal is not obtained and leakage can readily occur.

It therefore would be desirable to provide a linerless adhesively sealed sift proof carton and method of assembly that can be utilized in an intermittent or continuous motion carton erecting and sealing system and can accommodate a variety of granular and powdered materials without leakage.

SUMMARY OF THE INVENTION

The present invention provides a sift proof carton and method of folding and sealing the major and minor end flaps of the carton with an adhesive. The method is preferably a two surface fold method that includes providing a carton having at least a first open end having a first inside major flap, a second outside major flap and a pair of opposing minor flaps. Each flap includes a first proximal end connected for rotation with respect to the first open end for closing off the first open end, a second distal end, and opposite sides.

The minor flaps are first folded to cover or partially cover the open end of the carton and opposite sides of the first major flap are mitered with a predetermined pattern. The first and second inside and outside major flaps are then positioned in an open position and the carton is set in motion. During movement of the carton, a stationary adhesive nozzle member applies adhesive to selected areas of the second outside major flap and both of the minor flaps.

The first inside major flap is then folded into engagement with the minor flaps, and the second outside major flap is folded into direct contact with the inside major flap and both of the minor flaps. This adhesive and folding pattern provides sift proof sealing contact between the flaps about the entire periphery of the first open end of the carton.

In order to increase the sift proof qualities of the carton, the pattern of the miter on the first inside major flap as well as the location and amount of adhesive can be adjusted. Additionally, the second outside major flap and/or the pair of minor flaps can be debossed and embossed, respectively, to vary the engagement therebetween.

The above method can be utilized in a continuous system or an indexing system, particularly during movement between stations, or any other system.

BRIEF DESCRIPTION OF THE DRAWINGS

Various other objects, features, and attendant advantages of the present invention will be more fully appreciated from the following detailed description, when considered in connection with the accompanying drawings in which like reference characters designate like or corresponding parts throughout the several views, and wherein.

DESCRIPTION OF THE PREFERRED EMBODIMENTS

Figure 1:
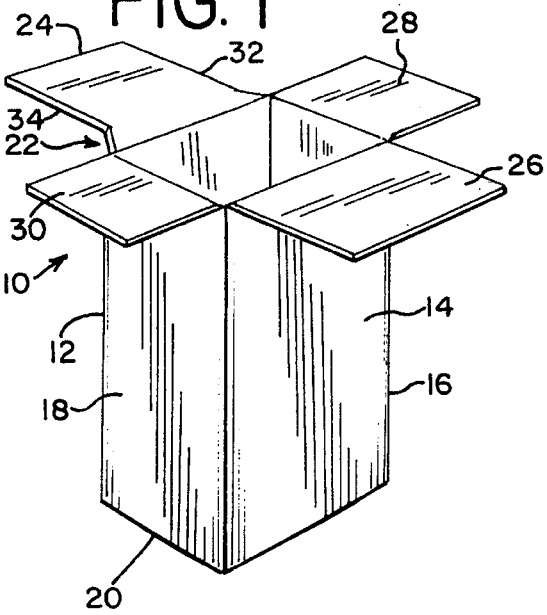
FIG. 1 is a perspective view of a carton of the invention illustrating an open end thereof and the respective major and minor flaps which are to be folded utilizing a two surface folding method to provide a sift proof container.

Referring to FIG. 1, a carton which is to be folded and sealed according to the principles of the present invention is generally designated by the reference numeral 10. The carton 10 is preferably rectangular and made of paperboard, but the particular shape and material of the carton 10 can vary.

The carton 10 preferably includes first and second major panels 12 and 14, first and second opposing minor panels 16 and 18, a bottom 20 and top 22. The bottom 20 and top 22 are initially provided in an open condition and are closed off by a plurality of flaps as described in detail below.

For ease of description, the present invention will be described with respect to the carton 10 where the bottom 20 is already provided in a closed condition and sealing of flaps is described only with respect to the top 22. It is to be understood, however, that the principles of the present invention can be applied to the folding and sealing of the flaps of the top 22 and/or bottom 20 in any desired order and with both the top 22 and bottom 20 initially opened.

The top 22 includes a first inside major flap 24, a second outside major flap 26, and first and second minor flaps 28 and 30. Each flap 24, 26, 28 and 30 is hingedly attached to the sides 12, 14, 16 and 18, respectively, of the carton 10 for folding over and sealing the open top 22. Preferably, the flaps 24, 26, 28 and 30 are scored to provide the hinged attachment.

The second outside major flap 26 as well as the minor flaps 28 and 30 are substantially rectangular in shape. The first inside major flap 24, however, is cut or mitered along opposite sides 32 and 34 with a predetermined pattern. As described below, this mitered pattern enables direct contact between the second outside major flap 26 and the minor flaps 28 and 30 upon folding.

Figure 2:
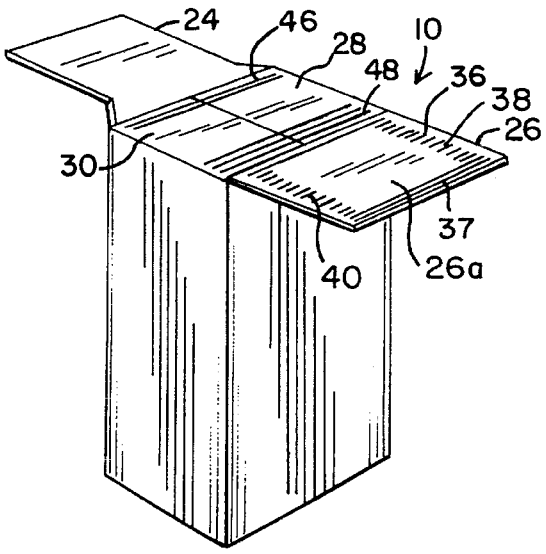
FIG. 2 is a perspective view, similar to FIG. 1, but illustrating the minor flaps in a folded position and a preferred adhesive pattern applied to selected areas of the minor flaps and the outside major flap.
Figure 5:
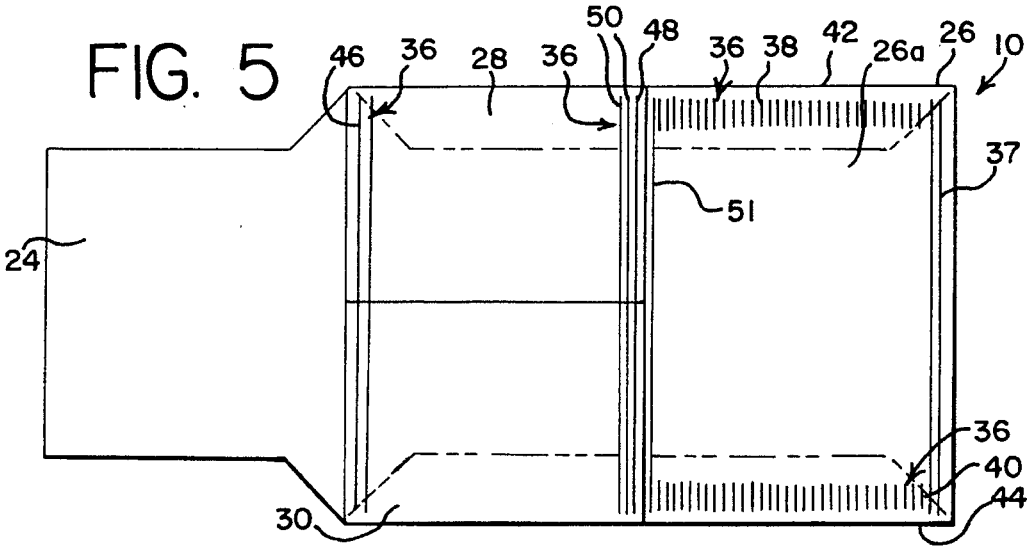
FIG. 5 is a top plan view of the carton of FIG. 2 with the preferred adhesive pattern illustrated in solid lines and the position of the first inside major flap illustrated in dotted lines on both the minor flaps and the second outside major flap to show the areas of engagement therebetween when folded.

As FIGS. 2 and 5 illustrate, in order to seal the flaps 24, 26, 28 and 30 of the carton 10, an adhesive generally illustrated with the reference numeral 36 is applied over selected areas of the second outside major flap 26 and the minor flaps 28 and 30. The adhesive 36 is preferably provided in a predetermined pattern and is readily adjustable. It is to be understood, however, that the particular pattern of adhesive 36 can vary.

In the present invention, the cooperation between the particular flaps 24–30 and the pattern of adhesive 36 provides the unique sift proof features of the invention. The adhesive 36 is a relatively quick setting adhesive selected so that it will "bite" or grip the flaps 24–30 upon engagement when folded and maintain that grip until fully cured.

The adhesive 36 is preferably applied by a non-contact nozzle plate or head (not illustrated) which is stationary within the intermittent or continuous system and includes a plurality of adhesive outlet apertures, nozzles or injection needles which are arranged and controlled in a plurality of zones. The carton 10 is passed over or under the stationary nozzle plate where the zones as well as the duration or length of beads can be adjusted to vary the pattern as desired.

In an intermittent system the nozzle plate is positioned so that it is activated when the carton 10 is indexed or moved to the next station. In a continuous system, the nozzle plate is positioned for activation as the carton 10 passes thereby.

In a preferred embodiment, the adhesive is a packaging grade adhesive which can be a hot-melt or cold adhesive. The application head includes the nozzle plate and corresponding valve systems supplied by the assignee herein under the name "Mod-Plus" and related assemblies.

As FIGS. 2 and 5 illustrate, a portion of the adhesive 36 is provided on an inside surface **26*a* of the second outside major flap 26 and includes an edge caulk line 37 and two strips 38 and 40, each strip including a plurality of parallel segments of adhesive. The strips 38 and 40 are applied proximate opposite sides 42 and 44 of the second inside surface 26*a* and engage the minor flaps 28 and 30 when folded as described herein. The edge caulk line 37 provides a seal between the first inside major flap 24 and the second outside major flap 26. The caulk line 37** can be either a single line or multiple lines.

To provide a corner seal between the first inside major flap 24 and the minor flaps 28 and 30, a first caulk line 46 is provided as a single line or multiple lines of adhesive 36. The first caulk line 46 extends across both the minor flaps 28 and 30 near the proximal end of the first inside major flap 24 so as to provide sealing therebetween.

Similarly, to provide a corner seal between the second outside major flap 26 and the minor flaps 28 and 30, at least one second caulk line 48 is provided as a single line of adhesive 36. The second caulk line 48 extends across both the minor flaps 28 and 30 near the proximal end of the second outside major flap 26 so as to provide sealing engagement therebetween.

As FIG. 5 illustrates, in order to increase the sealing at the corners between the minor flaps 28 and 30 and the second outside major flap 26, the second caulk line 48 can include one or more auxiliary caulk lines 50. The auxiliary caulk lines 50 likewise span the minor flaps 28 and 30 and are typically utilized when the carton 10 is filled with very fine powder so as to assist in preventing leakage at this location.

To provide even further securement between the minor flaps 28 and 30 and the second outside major flap 26, one or more additional caulk lines 51 can be provided on the second outside major flap 26. The caulk line or lines 51 spans the width of the second outside major flap 26 and contacts the caulk line 48 and/or lines 50.

The carton 10 is preferably erected and sealed in a continuous system (not illustrated) where the carton 10 is transported through the continuous system in a horizontal direction with respect to FIG. 5. The particular direction of travel, however, can vary and the carton 10 can be assembled in an intermittent system if desired by applying the adhesive 36 as the carton 10 is indexed between stations.

Figure 3:
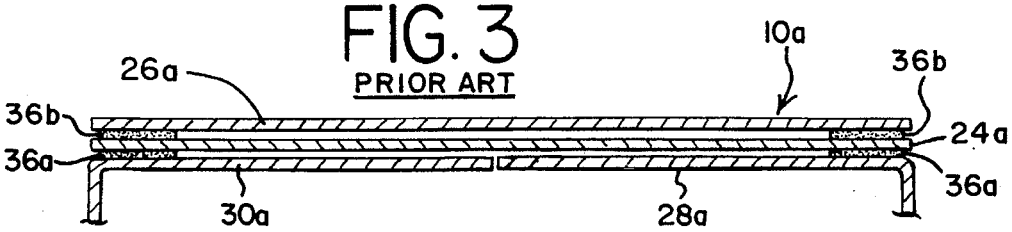
FIG. 3 PRIOR ART
FIG. 3 is a cross-sectional view of an end portion of a prior art three surface conventionally folded carton and the adhesive between the minor flaps and the inside major flap as well as between the inside major flap and the outside major flap.

FIG. 3 illustrates a prior art three surface conventional fold method with a carton generally illustrated by the reference numeral **10*a*. In this method, the minor flaps 28*a* and 30*a* are first folded to cover the open end of the carton 10*a* and bands of adhesive 36*a* are applied to the minor flaps 28*a* and 30*a*. The first inside major flap 24*a* is then folded to contact the adhesive bands 36*a* and connect the first inside major flap 24*a* to the minor flaps 28*a* and 30*a***.

Bands of adhesive **36*b* are then applied to the first inside major flap 24*a* and the second outside major flap 26*a* is folded to contact the adhesive bands 36*b* and connect the first and second major flaps 24*a* and 26*a*. Accordingly, the first inside major flap 24*a* serves to adhesively secure the second outside major flap 26*a* and both of the minor flaps 28*a* and 30*a***.

The particular adhesive and folding arrangement illustrated by FIG. 3 is known as a three surface conventional fold because sealing is provided between the three layers of flaps or surfaces which close the carton 10, namely the first and second major flaps 24 and 26 and the surface formed by both minor flaps 28 and 30. Not only does sifting still occur in such cartons **10*a***, but the amount of adhesive utilized is significantly increased thereby raising the cost of manufacturing.

As FIG. 5 illustrates, however, the carton 10 of the present invention provides a two surface fold by enabling direct contact of the second outside major flap 26 with the minor flaps 28 and 30 with the adhesive strips 38 and 40 therebetween. This design eliminates a surface between which granular or powdered material can migrate providing a more effective seal and reducing the total amount of adhesive utilized and the associated costs.

Figure 15:
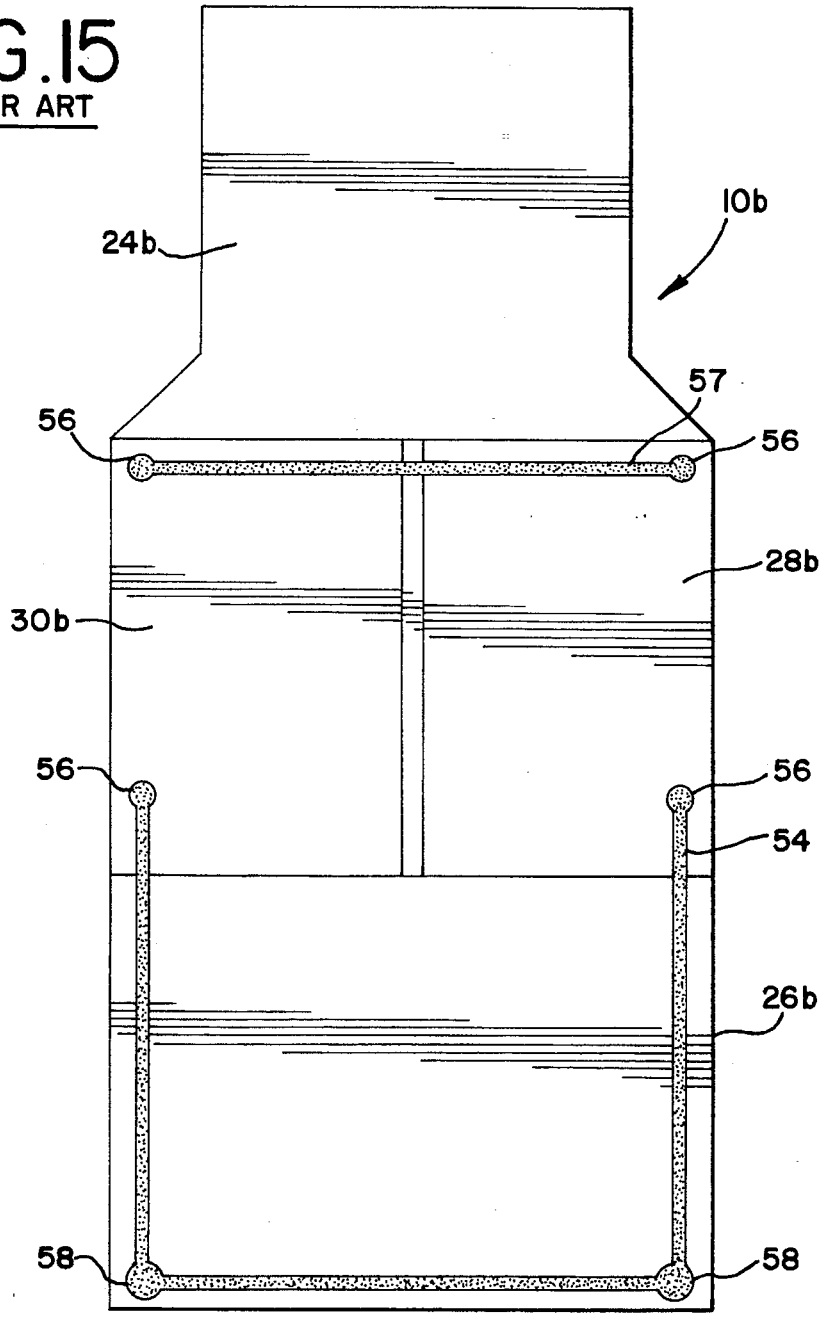
FIG.15 PRIOR ART
FIG. 15 is a top plan view of a prior art carton and the adhesive pattern utilized therewith.

As FIG. 15 illustrates, an existing two surface folded carton formed by an intermittent system is designated generally by the reference numeral **10*b*. As described briefly above, the carton 10*b* includes two different beads of adhesive 52 and 54. The bead 52 extends across both the minor flaps 28*b* and 30*b* and is supplied from a first stationary adhesive head (not illustrated) while the carton 10*b*** is moved between stations in the intermittent system.

The second bead 54 is applied from a second movable adhesive head (not illustrated) in a substantially U-shaped pattern again while the carton **10*b* is held stationary for a prescribed period of time. With each bead 52 and 54, starting and stopping of the respective adhesive head causes globs 56 of excess adhesive to be applied. Similarly, when the second adhesive head applies the U-shaped bead 54, it must make two ninety degree turns. Each turn substantially causes the second head to start, stop and change directions thereby causing globs 58** of excess adhesive to be applied.

The globs 56 and 58 require a longer open time thereby causing poor seals. Additionally, such globs 56 and 58 tend to squeeze out from between the flaps when the flaps are folded which is an undesirable condition to the end user causing unsightly adhesive on the carton exterior and possible contamination of the container contents. The globs 56 and 58 can also spread adhesive on a parent or master carton which can contain a plurality of cartons 10 for shipping.

Additionally, as FIGS. 15 specifically illustrates, the beads 52 and 54 are not uniform in thickness. Thus, each bead 52 and 54 tends to be somewhat thin proximate its center which reduces the open time of the adhesive and again provides poor sealing.

The primary cause of such thinning appears to be the acceleration and deceleration of the carton or bead heads as adhesive is applied from a full stop position. For example, as the first head applies the bead 52, it begins with the carton at substantially a full stop at one end of the bead 52. Once the first head is turned on, pressure built up within the head tends to provide a starting glob 56 and initial movement of the carton is slightly less than full speed, thereby causing the head to initially apply slightly more adhesive.

As the carton picks up speed, the bead 52 thins out slightly toward the middle of the bead 52. Upon approaching the end of the bead 52, the carton must begin to decelerate, thereby causing the bead 52 to once again thicken toward the end where it stops and tends to emit another glob 56. Similar problems exist with the bead 54 and the moving adhesive head.

Accordingly, such a two surface method is not very effective in preventing leakage because of the inconsistent adhesive pattern and physical limitations of the equipment. Due to the inconsistencies involved in applying such an adhesive, predicting the exact pattern actually applied and allowing for deviations would be very complex if not impossible within the limitations of the system.

In contrast, the adhesive pattern 36 of the present invention and its application is designed to overcome the problems of existing two surface fold methods by providing individual segments of adhesive in precise locations about the carton 10 from stationary adhesive heads. The heads apply a uniform layer of adhesive upon a carton that is moving with respect to the heads at a constant or variable speed thereby eliminating any thinning problems.

Additionally, due to the design of the adhesive head and the use of thinner, multiple line segments, globbing of adhesive is virtually eliminated. Thus, the flow of adhesive during folding can be controlled and more accurately predicted to provide better sealing. For example, the adhesive segments can be provided closer to the sides 42 and 44 of the second outside major flap 26 without causing adhesive to squeeze out while providing a seal immediately adjacent to the edge.

It is to be noted that, despite the use of segments, the adhesive 36 still provides a complete or continuous seal about the carton 10. This is due to the outward flow of adhesive which covers or fills in the gaps between segments during folding and slight compression of the flaps.

In the present invention, the adhesive 36 is preferably applied with a single, stationary adhesive head having a plurality of apertures which can be designed to provide the various caulk lines 37, 46, 48 and 50 as well as the strips 38 and 40. To provide the adhesive 36 as illustrated in FIG. 5, the adhesive head is divided into four zones, one each for the caulk line 46, the caulk lines 48 and 50, the strips 38 and 40, and the edge caulk line 37. The initiation and duration of the application of adhesive 36 is adjusted so as to vary the position and length of the lines of applied adhesive 36 with respect to the carton 10 as it passes by the adhesive head.

Figure 4:
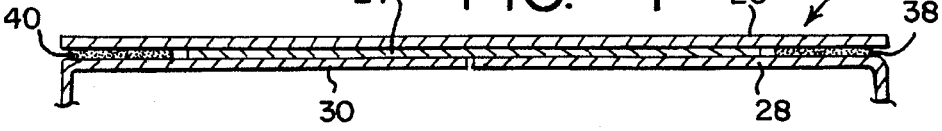
FIG. 4. is a cross-sectional view of an end portion of the two surface folded carton of the invention illustrating a mitered inside major flap and adhesive applied only between the outside major flap and the minor flaps.
Figure 6:
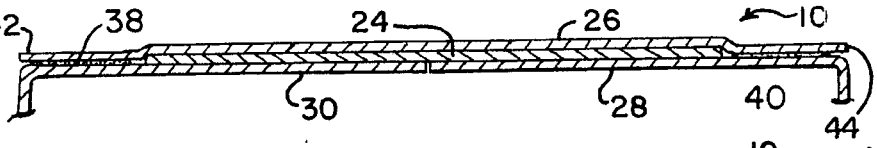
FIG. 6 is a cross-sectional view of the flaps of the two surface folded carton of the invention illustrating an embodiment for increasing sealing between the minor flaps and the second outside major flap.
Figure 7:
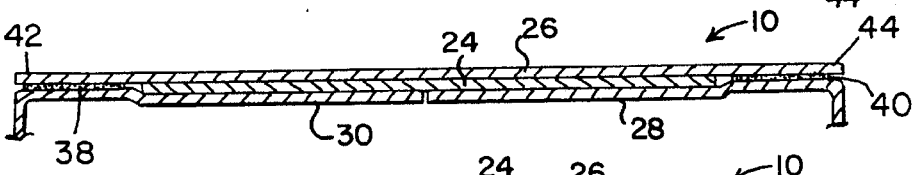
FIG. 7 is a cross-sectional view similar to FIG. 6 illustrating another embodiment for increasing sealing between the minor flaps and the second outside major flap.
Figure 8:
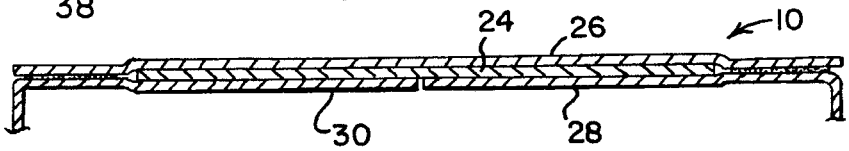
FIG. 8 is a cross-sectional view similar to FIGS. 6 and 7 illustrating yet another embodiment for increasing sealing between the minor flaps and the second outside major flap.
Figure 9:
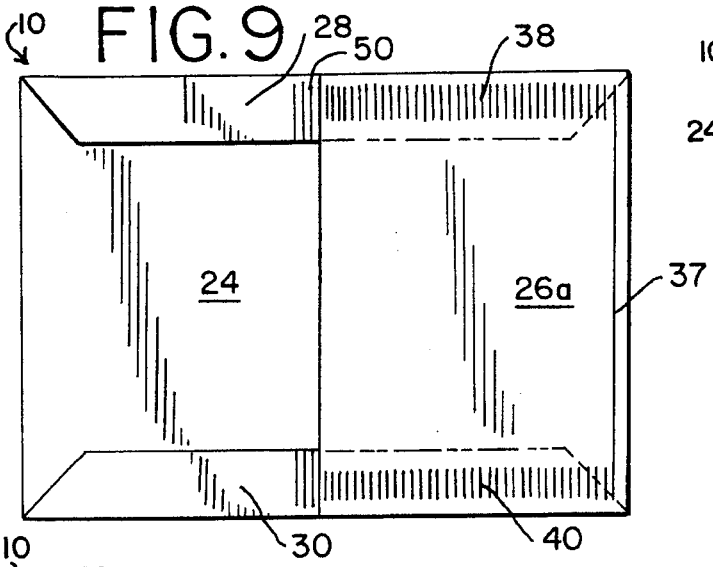
FIG. 9 is a top plan view of the carton of FIGS. 2 and 5 with the minor flaps and the first inside major flap folded inward.

FIGS. 6–8 illustrate various embodiments of the present invention which are designed to increase the adhesion between the second outside major flap 26 and the inside minor flaps 28 and 30. Referring to FIG. 4, in accordance with a two surface folding method the adhesive strips 38 and 40 must span the gap between the second outside major flap 26 and the inside minor flaps 28 and 30 which is substantially equivalent to the thickness of the first inside major flap 24 captured therebetween.

Accordingly, the adhesive strips 38 and 40 must be sufficiently thick to span this gap. As described above, thicker adhesive not only increases the amount of adhesive applied and the associated costs of manufacturing, but the open time must be lengthened to ensure proper sealing which results in slower running of the assembling system or a longer and more costly compression system. Thus, if the thickness of the adhesive can be reduced, significant cost savings can be achieved from the reduction of material utilized and the increase in the speed and output of the assembling system. This can reduce floor space requirements from compression systems.

FIGS. 6–8 illustrate various ways of decreasing the gap between the second outside major flap 26 and the inside minor flaps 28 and 30 so as to in turn decrease the thickness of the adhesive 36. In FIG. 6, the opposite sides 42 and 44 of the second major flap 26 in the areas of the adhesive strips 38 and 40 are embossed toward the minor flaps 28 and 30. The embossing decreases the gap by approximately half the thickness of the first inside major flap 24.

Similarly, as FIG. 7 illustrates, portions of the minor flaps 28 and 30 are debossed in the areas beneath the adhesive strips 38 and 40. The debossing likewise decreases the gap by approximately half the thickness of the first inside major flap 24.

Alternatively, as FIG. 8 illustrates, both embossing and debossing, as illustrated in FIGS. 6 and 7, of the second outside major flap 26 and the inside minor flaps 28 and 30 can be combined. In this embodiment, the gap is substantially reduced.

Figure 10:
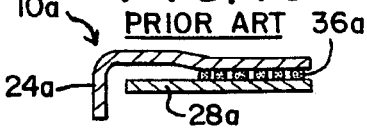
FIG. 10 PRIOR ART
FIG. 10 is a cross-sectional view of a portion of a corner seal of a prior art two or three surface carton sealing method illustrating the potential for leakage between a minor flap and the first inside major flap.

As FIG. 10 illustrates, existing cartons 10*a* tend to exhibit leakage at the corners, particularly at the corner between the first inside major flap 24*a* and the minor flaps, such as flap 28*a*. Leakage occurs since the adhesive 36*a* does not extend completely to the end of the minor flap 28*a* leaving a gap between the inside major flap 24*a* and the minor flap 28*a*.

If the adhesive 36*a* is deposited too close to the ends of the minor flaps 28*a* and 30*a*, it will squeeze into the interior of the carton 10*a*, which is not desirable.

The adhesive pattern 36 of the present invention combined with the mitered first inside major flap 24 provide excellent sift proof sealing about the entire periphery of the top or bottom 22 or 20 of the carton 10 including the corners. With extremely fine powders, however, such as flour or cement, some leakage might occasionally occur if the sealed carton 10 is subjected to abnormal and extreme vibrations. Such leakage is confined, however, to the seal at the corners provided by the caulk line 46 between the minor flaps 28 and 30 and the first inside major flap 24.

FIGS. 11–14 illustrate various embodiments of the present invention which are directed to solving the leakage at the above described corner. Although these embodiments are directed toward use preferably with a two surface folding method, they can be equally applicable to any type of method or carton.

Figure 11:
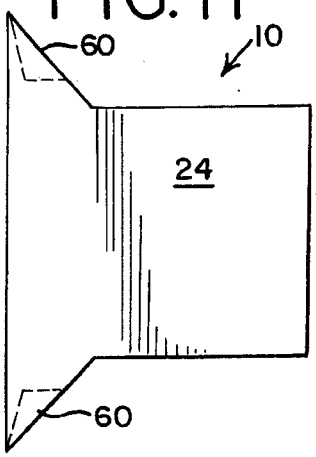
FIG. 11 is a top plan view of an alternate embodiment of the first inside major flap of the carton of the invention which provides increased sealing at the corners.
Figure 12:
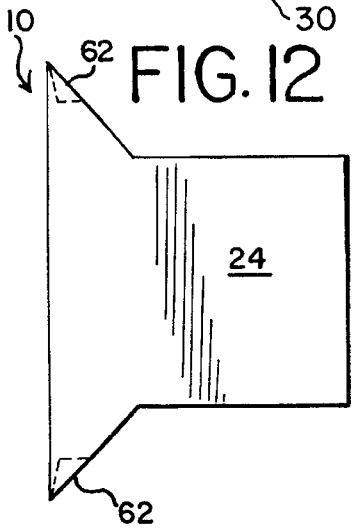
FIG. 12 is a top plan view of another embodiment of the first inside major flap of the carton of the invention which provides increased sealing at the corners.

As FIGS. 11 and 12 illustrate, the first inside major flap 24 can be provided with a second miter cut 60 and 62 respectively. Each second miter cut 60 and 62 enables the adhesive strips 38 and 40 to contact the minor flaps 28 and 30 closer to the corner, with the second miter cut 62 being somewhat closer to the corner than the second miter cut 60.

Figure 13:
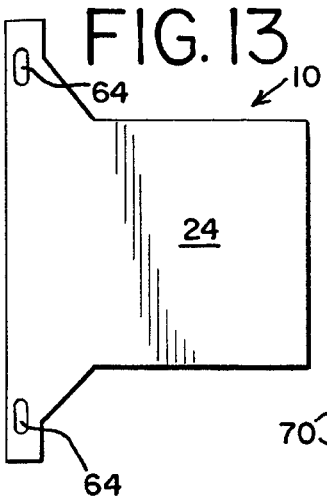
FIGS. 13 and 13*a* are top plan views of additional embodiments of the first inside major flap of the carton of the invention which provides increased sealing at the corners.

FIG. 13 illustrates another embodiment of the carton 10 where the first inside major flap 24 includes apertures 64 formed therethrough. The apertures 64 likewise enable the adhesive strips 38 and 40 to directly contact the minor flaps 28 and 30 proximate the corners. Although the apertures 64 are illustrated as oval, the shape and size can vary. Additionally, to further increase sealing, the minor flaps 28 and 30 can include protuberances (not illustrated) corresponding in size and shape to the apertures 64 for engagement with the second outside major flap 26 therethrough.

Figure 13A:
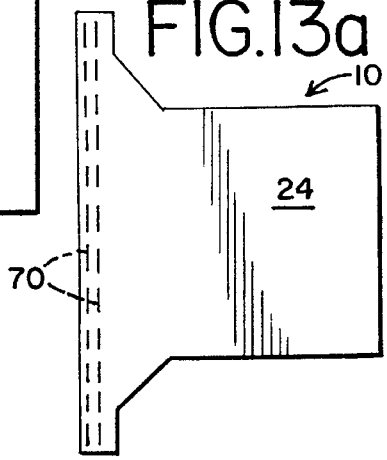

FIG. 13*a* illustrates another embodiment for increased corner sealing of the carton 10 where an inside surface of the first inside major flap 24 includes one or more caulk lines 70, illustrated in dotted lines. The caulk lines 70 contact the minor flaps 28 and 30 for sealing engagement therewith.

Figure 14:
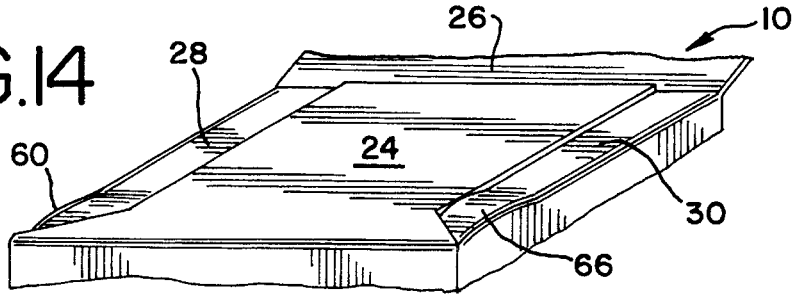
FIG. 14 is a partial perspective view of the two surface folded carton of the invention with the minor flaps and the first inside mitered major flap folded inwardly and illustrating another embodiment of the invention which provides increased sealing at the corners.

FIG. 14 illustrates another embodiment for increasing corner sealing of the carton 10 where the minor flaps 28 and 30 include raised bumps 66. The bumps 66 are positioned proximate the corners and enable the adhesive on the second outside major flap 26 to directly contact the minor flaps 28 and 30. Debossing on the second outer major flap 26 in this area can assist in spanning the gap between the minor flaps 28 and 30 and the second outside major flap 26.

Modifications and variations of the present invention are possible in light of the above teachings. It is to be understood that within the scope of the claims the invention may be practiced other than specifically described.

I claim:

1. A sift proof carton, comprising:

a carton member having at least a first open end and comprising a first inside major flap, a second outside major flap, and a pair of opposed minor flaps, each one of said flaps including a first proximal end connected along a fold line to a body portion of said carton member for pivotal movement with respect to said first open end of said carton member for closing said first open end of said carton member when folded inwardly, a second distal end, and opposite sides, said pair of opposed minor flaps comprising a first closure surface with respect to said first open end of said carton member when folded inwardly, said first inside major flap comprising a second closure surface with respect to said first open end of said carton member by being disposed upon said pair of opposed minor flaps when folded inwardly and including first mitered portions along said opposite sides thereof, said second outside major flap comprising a third closure surface when folded inwardly with respect to said first open end of said carton member by being disposed upon both said first inside major flap and portions of said pair of opposed minor flaps, extending along said first proximal ends thereof, as a result of said portions of said pair of opposed minor flaps, extending along said first proximal ends thereof, being exposed and accessible to said second outside major flap by said mitered portions of said first inside major flap, and at least one of said pair of opposed minor flaps and said second outside major flap having embossed means formed along at least one of said exposed and accessible portions of said pair of opposed minor flaps extending along said first proximal ends of said pair of opposed minor flaps, and said opposite sides of said second outside major flap, so as to extend toward the other one of said pair of opposed minor flaps and said second outside major flap; and adhesive means, provided upon an inside surface of said second outside major flap and upon outside surfaces of said pair of opposed minor flaps, for providing seals between said pair of opposed minor flaps and said first and second inside and outside major flaps, and between said first and second inside and outside major flaps, said adhesive means comprising a first adhesive strip provided upon said outside surfaces of said pair of opposed minor flaps so as to extend across both of said minor flaps and substantially from one side of said carton body to the other side of said carton body, and along one of said opposite sides of said pair of opposed minor flaps, so as to be disposed adjacent to said fold line of said first proximal end of said first inside major flap such that edge and corner sealing is achieved between said pair of opposed minor flaps and said first inside major flap when said pair of opposed minor flaps and said first inside major flap are folded inwardly with respect to said carton body; a second adhesive strip provided upon said outside surfaces of said pair of opposed minor flaps so as to extend across both of said minor flaps and substantially from said one side of said carton body to said other side of said carton body, and along the other one of said opposite sides of said pair of opposed minor flaps, so as to be disposed adjacent to said fold line of said first proximal end of said second outside major flap such that said second distal end of said first inside major flap is sealed to said pair of opposed minor flaps along said other one of said opposite sides of said pair of opposed minor flaps when said pair of opposed minor flaps and said first inside major flap are folded inwardly with respect to said carton body; a third adhesive strip provided upon said inside surface of said second outside major flap so as to extend across said second outside major flap substantially from said one side of said carton body to said other side of said carton body, and along said second distal end of said second outside major flap, such that said second distal end of said second outside flap is sealed to said first proximal end of said first inside major flap when said first and second inside and outside major flaps are folded inwardly with respect to said carton body; and a pair of fourth adhesive strips provided upon said inside surface of said second outside major flap and extending respectively along said opposite sides of said second outside major flap substantially between said first proximal end of said second outside major flap and said third adhesstrip extending along said second distal end of said second outside major flap for direct engagement with said portions of said pair of minor flaps, exposed by said mitered portions of said first inside major flap and extending along said first proximal ends of said pair of opposed minor flaps, as a result of said embossed means formed upon at least one of said exposed and accessible portions of said pair of opposed minor flaps and said second outside major flap, and extending toward the other one of said pair of opposed minor flaps and said second outside major flap, upon folding of said carton flaps so as to provide a seal between said opposite sides of said second outside major flap and said first proximal ends of said pair of opposed minor flaps.

2. The carton as defined in claim 1 wherein said minor flaps include embossed portions substantially corresponding in shape to said first mitered portions of said first inside major flap to decrease the distance and adhesive between said minor flaps and said second outside major flap and increase the seal therebetween.

3. The carton as defined in claim 1 wherein said second outside major flap includes debossed portions substantially corresponding in shape to said first mitered portions of said first inside major flap to decrease the distance and adhesive between said minor flaps and said second outside major flap and increase the seal therebetween.

4. The carton as defined in claim 1 wherein said minor flaps include embossed portions and said second outside major flap includes debossed portions substantially corresponding in shape to said first mitered portions of said first inside major flap to decrease the distance and adhesive between said minor flaps and said second outside major flap and increase the seal therebetween.

5. The carton as defined in claim 1 wherein said first inside major flap includes second mitered portions having a predetermined pattern formed on opposite sides thereof for increasing the corner seal between said minor flaps and said second outside major flap.

6. The carton as defined in claim 1 including a pair of apertures formed through said first inside major flap proximate said proximal end thereof for increasing the corner seal between said minor flaps and said second outside major flap.

7. The carton as defined in claim 1 including displacing a portion of said minor flaps proximate their proximal ends for increasing the corner seal between said minor flaps and said second outside major flap.

8. The carton as defined in claim 1 wherein said carton is formed as a sift proof master carton including a plurality of discrete packages therein.

9. The carton as set forth in claim 1, wherein:

said fourth adhesive strips each comprises a plurality of uniformly spaced parallel adhesive segments.

10. The carton as set forth in claim 9, wherein:

said parallel segments of said adhesive strips are disposed parallel to said said first, second, and third adhesive strips, and said fourth adhesive strips extend in a direction along said second outside major flap which is substantially perpendicular to the directions in which said first, second, and third strips of adhesive extend.

11. The carton as set forth in claim 1, wherein:

said first inside major flap comprises a substantially rectangularly configured portion disposed immediately adjacent said first proximal end thereof so as to be interposed between said first proximal end thereof and said first mitered portions thereof; and a fifth adhesive strip is disposed upon said substantially rectangular portion of said first inside major flap for enhancing said corner sealing between said pair of opposed minor flaps and said first inside major flap.

* * * * *